United States Patent [19]

Evans

[11] Patent Number: 4,525,970

[45] Date of Patent: Jul. 2, 1985

[54] INSULATED WALL CONSTRUCTION

[75] Inventor: Michael E. Evans, Granville, Ohio

[73] Assignee: Owens-Corning Fiberglas Corporation, Toledo, Ohio

[21] Appl. No.: 512,256

[22] Filed: Jul. 11, 1983

[51] Int. Cl.[3] ..... E04B 5/52

[52] U.S. Cl. ..... 52/454

[58] Field of Search ..... 52/302, 409, 443, 447, 52/454, 457, 458, 518, 519, 520, 540, 574, 578, 660, 782, 783, 784, 821, 273, 274, 293, 318, 451–453, 592; D25/80; 404/35

[56] References Cited

U.S. PATENT DOCUMENTS

| | | | |
|---|---|---|---|
| 1,462,579 | 7/1923 | Roberts | 52/447 |
| 1,536,932 | 5/1925 | Rolfe | 52/443 |
| 1,677,073 | 7/1928 | Cohen | 52/451 |
| 1,702,096 | 2/1929 | Thompson | 52/447 |
| 2,022,161 | 11/1935 | Spafford | 52/578 |
| 2,186,461 | 1/1940 | Thompson | 52/454 |
| 2,255,367 | 9/1941 | Schenk et al. | 52/578 |
| 3,111,787 | 11/1963 | Chamberlain | 52/409 |
| 3,125,831 | 3/1964 | Marsch et al. | 52/443 |
| 3,307,306 | 3/1967 | Oliver | 52/409 |
| 3,919,443 | 11/1975 | Porter | 52/578 |
| 4,191,001 | 3/1980 | L'Heurex | 52/743 |
| 4,241,555 | 12/1980 | Dickens et al. | 52/454 |

FOREIGN PATENT DOCUMENTS

| | | | |
|---|---|---|---|
| 2842879 | 4/1980 | Fed. Rep. of Germany | 52/454 |
| 2845098 | 4/1980 | Fed. Rep. of Germany | 52/409 |

*Primary Examiner*—John E. Murtagh
*Assistant Examiner*—Andrew Joseph Rudy
*Attorney, Agent, or Firm*—Ronald C. Hudgens; Ted C. Gillespie; Paul J. Rose

[57] ABSTRACT

Each square fibrous insulation board has a scrim adhered to an outer side thereof and extending beyond two opposite edges thereof to provide a pair of opposite scrim flaps. The boards are oriented alternately at ninety degrees to each other on a wall to be insulated, whereby every horizontal joint and every vertical joint between adjacent boards is covered by a scrim flap. A cementitious coating is applied over the boards and scrim.

4 Claims, 2 Drawing Figures

INSULATED WALL CONSTRUCTION

TECHNICAL FIELD

This invention relates generally to exterior insulation of structural outer walls of buildings, and more particularly, to an external insulation system for existing buildings, although it is also applicable to new buildings.

BACKGROUND ART

U.S. Pat. No. 4,191,001 discloses a method of exteriorly insulating existing concrete block walls by applying furring strips, expanded polystyrene boards over the furring strips, chicken wire stapled to the polystyrene boards, and a concerete coating over the chicken wire and polystyrene boards. The butt joints between boards are sealed with a polystyrene glue. The stapling of the chicken wire and the glueing of the butt joints is relatively time consuming. Further, the polystyrene board has a relatively high coefficient of thermal expansion. Therefore, the concrete coating must have an elastomeric bonding agent to compensate for thermal expansion and contraction of the board. In addition, polystyrene board is not acceptable under various fire codes.

DISCLOSURE OF THE INVENTION

In accordance with the invention, square fibrous insulation boards are provided which have a scrim adhered thereto in the factory, with loose flaps at two opposite edges for overlapping of joints. Fasteners are provided with washers for holding the scrim as well as the boards. Adjacent boards are rotated ninety degrees from each other in order that both horizontal and vertical joints are covered by the flaps. Furring strips, stapling of chicken wire, and glueing of butt joints are eliminated. The scrim helps retain and reinforces a cementitious cover layer. When the boards are glass fiber boards, they are acceptable under fire codes.

BRIEF DESCRIPTION OF DRAWINGS

The invention is more fully explained hereinafter with reference to the accompanying drawings wherein.

BEST MODE OF CARRYING OUT THE INVENTION

Figure 1:
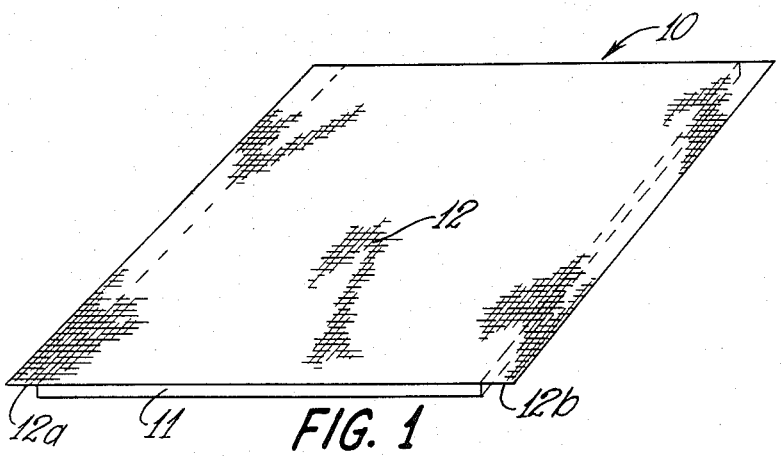
FIG. 1 is a perspective view of a square fibrous insulation board having a scrim adhered thereto in accordance with the invention, the scrim being larger than the board to provide loose flaps respectively along two opposite edges.
Figure 2:
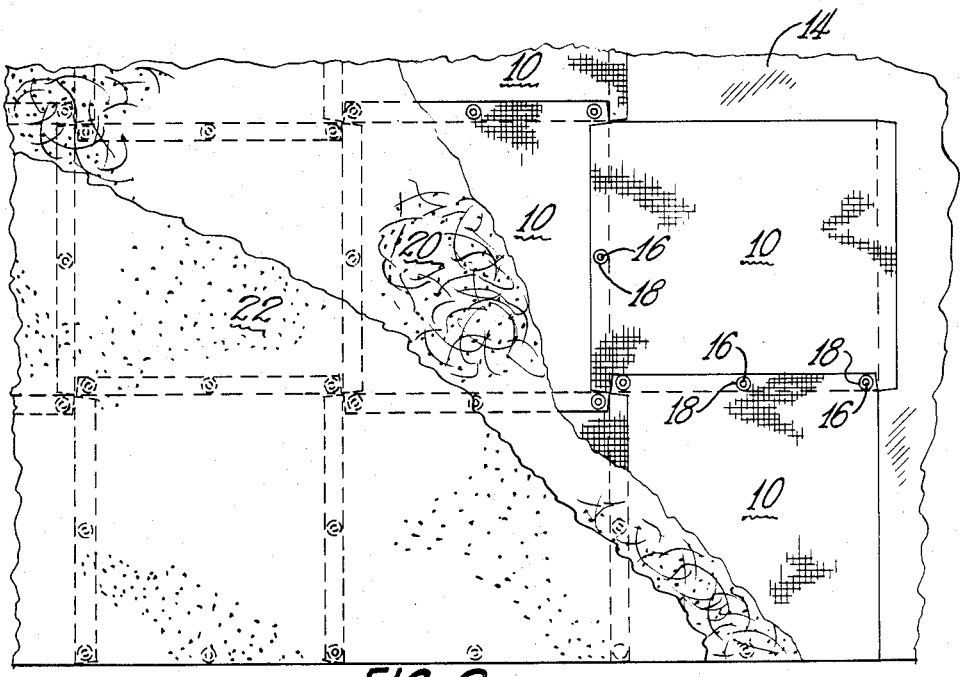
FIG. 2 is an elevational view showing an insulated wall system constructed in accordance with the invention.

With reference to the drawings, scrim-faced square fibrous insulation boards 10 constructed in accordance with the invention are shown in FIGS. 1 and 2. Each board 10 includes a fibrous board 11 and a scrim 12 adhered thereto. Preferably the fibrous board 11 is a glass fiber board and preferably the scrim 12 is a woven glass fiber scrim. When the board 11 is a glass fiber board, it preferably has a density of about four pounds per cubic foot and consists essentially of glass fibers impregnated with about thirteen percent by weight of a binder such as phenol-urea-formaldehyde resin. The preferred size of each board 11 is four feet by four feet by a thickness of about one to three inches. Preferably the scrim 12 has about six by six strands per square inch and, when made of glass fibers, is either alkali resistant glass fibers or glass fibers coated with a protective coating such as polyvinylchloride resin. The scrim 12 is flush with the board 11 respectively along two opposite edges thereof, but extends beyond the board to provide a pair of scrim flaps 12*a* and 12*b* respectively along the other two opposite edges thereof for overlapping joints between adjacent boards.

FIG. 2 shows a plurality of the boards 10 mounted on the exterior of a structural outer wall 14 of a building, which may be poured concrete, concrete block, brick, or stone. The boards 10 are positively fastened to the wall 14 by suitable mechanical fasteners 16 respectively provided with washers 18. Each board 10 is rotated ninety degrees from any other adjacent board located along any of its four edges. In this manner every horizontal joint and every vertical joint is overlapped by one of the flaps 12*a* or 12*b*. A cementitious base coat 20 is troweled over the boards 10 with their scrim 12, and preferably a cementitious finish coat 22 is troweled over the base coat 20.

Various modifications may be made in the structure shown and described without departing from the spirit and scope of the invention. For example, the boards 10 could be made of mineral or rock fibers and the scrim could be made of polyester resin.

I claim:

1. An insulated outer wall construction for a building, said wall construction comprising a structural outer wall, a plurality of square fibrous glass insulation boards mounted in covering relationship to said outer wall on a side thereof facing outwardly of the building, each of said boards having a scrim adhesively secured thereto on an outer side, the scrim extending beyond the board respectively along two opposite edges thereof to provide a pair of flaps for respectively overlapping joints between adjacent boards, the boards of each pair of adjacent boards being oriented ninety degrees from each other whereby every joint between boards is overlapped by a scrim flap, and a coat of cementitious material covering said boards and scrim.

2. A wall construction as claimed in claim 1 wherein the scrim is woven glass fiber scrim.

3. A wall construction as claimed in claim 1 wherein the fibrous glass boards have a density of about four pounds per cubic foot.

4. A wall construction as claimed in claim 1 wherein the fibrous glass boards comprise glass fibers impregnated with about thirteen percent by weight of a resin binder.

* * * * *